United States Patent [19]

Smith

[11] 4,166,336

[45] Sep. 4, 1979

[54] BUBBLE FORMING DEVICE

[76] Inventor: Forrest D. Smith, P.O. Box 222, Orleans, Calif. 95556

[21] Appl. No.: 787,769

[22] Filed: Apr. 15, 1977

[51] Int. Cl.[2] ..... A63H 33/28

[52] U.S. Cl. ..... 46/6

[58] Field of Search ..... 46/6–8

[56] References Cited

U.S. PATENT DOCUMENTS

| | | | |
|---|---|---|---|
| 657,163 | 9/1900 | Higgins | 46/6 |
| 721,373 | 2/1903 | Horton | 46/6 |
| 2,305,382 | 12/1942 | Hagopian | 46/6 |
| 2,396,433 | 3/1946 | Pimblett | 46/6 |

*Primary Examiner*—Louis G. Mancene
*Assistant Examiner*—Robert F. Cutting

[57] ABSTRACT

A bubble blowing device in the form of a funnel which is open at both ends. The small end serves as the mouthpiece, and the large end serves as the forming site for bubbles. The bubble forming end is configured so that a plane which is generally defined by the lip of the large end of the funnel extends at an acute angle to the longitudinal axis of the funnel. A film material supply surface is provided at the bubble forming end of the device.

6 Claims, 5 Drawing Figures

BUBBLE FORMING DEVICE

This invention relates to toy bubble blowing devices and particularly to toy bubble blowing devices having a generally funnel shaped configuration in which the bubble forming end is at the large end of the funnel and the bubble forming end is terminated in such a way that the opening is directed at an acute angle to the longitudinal axis of the funnel.

According to the present invention, bubbles may be blown either in an upward or downward direction while holding the funnel so that its longitudinal axis is approximately parallel with the horizon. The termination of the bubble forming end of the funnel in such a way that the opening projects at an acute angle to the longitudinal axis of the funnel allows the direction in which the bubble is blown to be controlled by rotating the funnel about its longitudinal axis so as to position the short side of the funnel on the side in which it is desired to blow the bubbles. When the short side of the funnel is on the upper side of the funnel, the bubbles will be blown upwardly, and when the short side is on the lower side of the funnel, the bubbles will be blown downwardly provided the longitudinal axis of the funnel is generally parallel to the horizon.

The bubble forming end of the funnel terminates in a lip which is formed so as to provide a surface area from which bubble forming material may be drawn as the bubble is forming. In this way very large bubbles can be blown, if desired. The lip of the bubble forming end of the funnel preferably is enlarged so as to provide a surface which generally lies in the general plane of the lip and presents an area which faces outwardly from the funnel. This area is wetted with bubble forming materials, such as an aqueous soap solution, and serves as a reservoir from which film forming material is drawn as the bubble is formed.

In general it is undesirable for bubble forming material to flow down the inside walls of the funnel toward the end of the funnel which serves as a mouthpiece. Preferably a barrier is provided in the funnel to block the flow of film forming material toward the mouthpiece end. Also, it is undesirable to have film forming material flow down the outside of the funnel towards the mouthpiece end because it may tend to drip on furniture or furnishings, or as with the flow on the inside of the funnel, it may tend to get into the operator's mouth. A flange or other barrier is conveniently provided on the outside of the funnel adjacent to the bubble forming end to prevent the flow of film forming material down the outside of the funnel.

Referring particularly to the drawings, there is illustrated:

Figure 2:
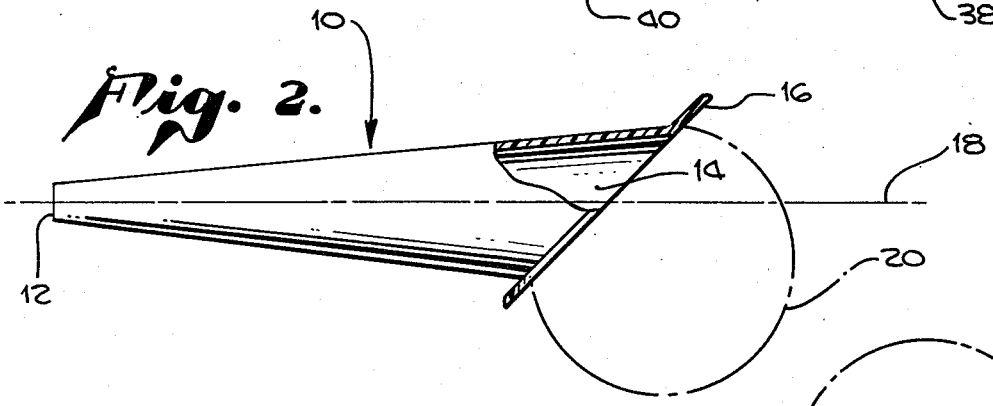
FIG. 2 is the bubble blowing device of FIG. 1 oriented so as to blow bubbles downwardly.
Figure 3:
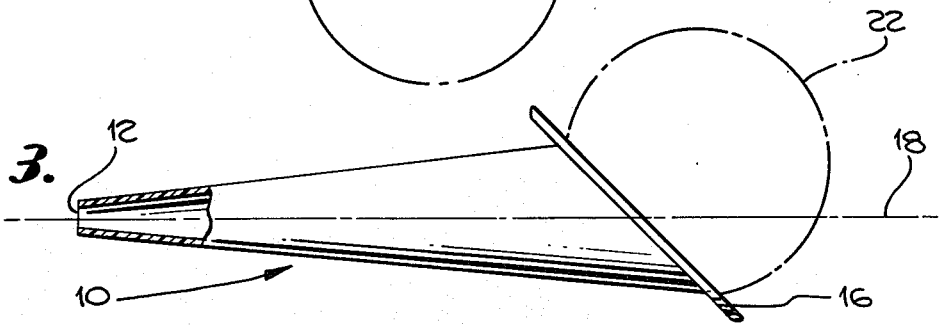
FIG. 3 is the bubble blowing device of FIG. 1 oriented so as to blow bubbles upwardly.

Referring particularly to the drawings, there is illustrated generally at 10 a bubble blowing device according to the present invention which has a generally elongated conical configuration which is open at both ends. The small end defines a mouthpiece end 12 which is adapted to being positioned relative to the operator's mouth so that it can be blown through. The larger end of the device 10 defines a bubble forming end 14. Bubble forming end 14 terminates in a lip 16 which is in the form of a generally radially extending flange which presents a generally planar surface which extends outwardly from the device 10. Bubble forming end 14 is terminated in such a way that lip 16 extends at an acute angle to the longitudinal axis 18 of device 10. Because lip 16 extends at an acute angle to longitudinal axis 18, the opening at bubble forming end 14 is elliptical. The acute angle at lip 16 and longitudinal axis 18 permits bubble 20 to be blown downwardly when longitudinal axis 18 is held parallel to the surface of the earth and the short side of device 10 is directed downwardly as illustrated in FIG. 2. Conversely, when the short side of the device 10 is oriented upwardly, bubble 22 will be blown upwardly as illustrated in FIG. 3.

Figure 1:
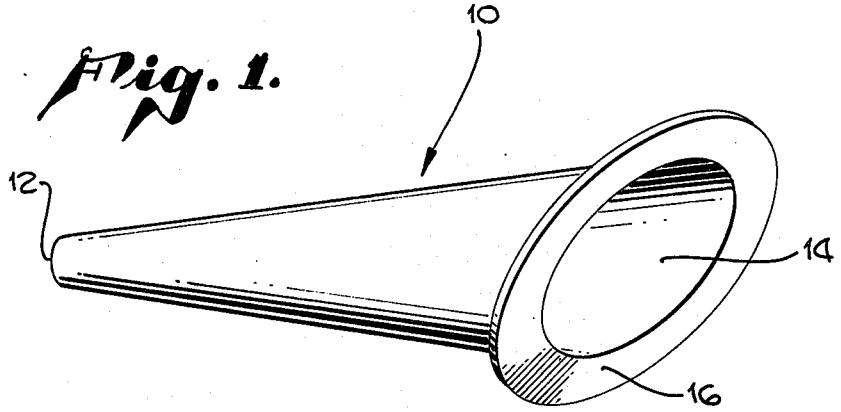
FIG. 1 is a perspective view of one embodiment of a bubble blowing device according to this invention.
Figure 4:
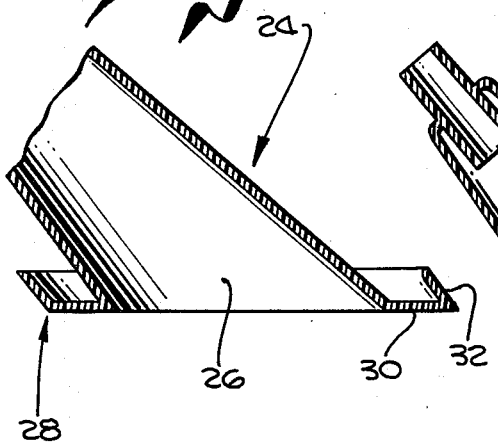
FIG. 4 is a partial cross-sectional view of a further embodiment in which a flange is provided to block the flow of film forming material down the exterior of the funnel.

Referring particularly to FIG. 4 there is illustrated a bubble forming device illustrated generally at 24 having a bubble forming end 26 which terminates in a lip 28. Lip 28 includes a flange 30 which extends generally radially outwardly from the walls of device 24 so as to present a film forming surface which faces outwardly from device 24. Flange 30 terminates in a second flange 32 which projects from the radially outer edge of flange 30 towards the mouthpiece end of device 24.

The provision of standing second flange 32 permits device 24 to be dipped into a shallow layer of film forming material such as an aqueous soap solution without getting any of the solution behind flange 30. Thus, excess soap solution is not in a position to either run down the length of device 24 or to drip off onto something below the device 24.

Figure 5:
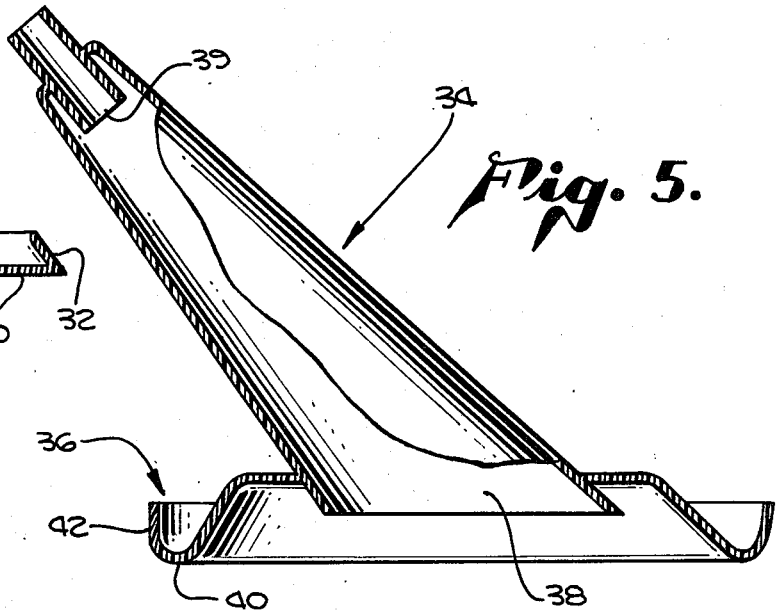
FIG. 5 is a broken cross-sectional view of an additional embodiment in which barriers are provided to prevent the flow of film forming material both down the interior and exterior of the funnel.

Referring particularly to FIG. 5, there is illustrated a bubble forming device indicated generally at 34. Device 34 is provided with a lip indicated generally at 36 and first and second internal film material barriers 38 and 39. Film supply surface 40 of lip 36 faces generally outwardly from device 34 and provides a surface from which film forming material may be drawn as a bubble is blown. Film supply surface 40 is positioned outwardly from the outermost edge of internal film material barrier 38 so that device 34 can be dipped into a shallow body of film forming material so as to form a film over the bubble forming end of device 34 without wetting the outermost edge of barrier 38 with film forming solution. Flange 42 defines the radially outermost portion of lip 36 and extends rearwardly from film supply surface 40 toward the mouthpiece end of device 34 so as to prevent film forming liquid from getting behind lip 36.

As will be readily appreciated by those skilled in the art, the lip at the bubble forming end of the device may extend at various acute angles to the longitudinal axis of the device ranging generally from between approximately 30 and 60 degrees and preferably from about 40 to 50 degrees. The funnel which defines the body of the bubble forming device may assume different cross-sectional configurations, including, for example, round, square, triangular, oval, and the like.

The presence of the film supply surface which generally faces outwardly from the body of the device permits the blowing of very large bubbles from which much enjoyment may be derived by the operator. The presence of internal and external barriers prevents the flow of film forming material along either the interior or exterior walls of the device and thus protects the operator from ingesting undesired film forming material as well as from dropping film forming material all over the immediate area. The cutting of the bubble forming end of the device at a bias permits the operator to hold the device in a horizontal position and blow bubbles upwardly, downwardly, or to the side as may be desired. Thus the operator does not need to tip the device upwardly and risk getting film forming solution on the face or in the eyes. The device may be constructed of any convenient material, such as wood, synthetic or organic materials, or metals. In general synthetic or organic materials, generally described as plastics, are preferred, and the device is manufactured by molding it in one operation as a single piece. The device may be conveniently designed so that only angles which readily permit their release from a mold are present in the unitary device.

What is claimed is:

1. A bubble forming device for blowing bubbles upwardly, downwardly or to the side comprising:

an elongated generally funnel shaped member open at both ends and having a mouthpiece end at the small end of said funnel shaped member and a bubble forming end at the large end of said funnel shaped member, said bubble forming end terminating in a lip, said lip defining generally a plane, said lip including a film supply surface positioned generally in said plane and facing generally away from said funnel shaped member, said plane extending at an acute angle to the longitudinal axis of said elongated generally funnel shaped member.

2. A bubble forming device of claim 1 wherein said acute angle extends at between approximately 30 and 60 degrees to the longitudinal axis of said elongated generally funnel shaped member.

3. A bubble forming device of claim 1 including means for blocking the flow of film forming material toward said mouthpiece end along the interior of said elongated generally funnel shaped member.

4. A bubble forming device of claim 1 wherein said lip includes a film barrier means for blocking the flow of film forming material toward said mouthpiece end along the exterior of said elongated generally funnel shaped member.

5. A bubble forming device for blowing bubbles upwardly, downwardly or to the side comprising:

an elongated generally conical tubular member the smaller end of said tubular member being a mouthpiece end and the larger end of said tubular member being a bubble forming end, said bubble forming end terminating in a lip, said lip extending around said tubular member at an acute angle to the longitudinal axis of said tubular member so as to generally define an ellipse, said lip being enlarged to provide a generally radially extending film supply surface, means for blocking the flow of film forming material along the exterior of said tubular member toward said smaller end, and means for blocking the flow of film forming material along the interior of said tubular member toward said smaller end.

6. A bubble forming device of claim 5 wherein said lip includes a flange extending generally in the plane of said ellipse.

* * * * *